US009808704B1

(12) United States Patent
Crossland et al.

(10) Patent No.: US 9,808,704 B1
(45) Date of Patent: Nov. 7, 2017

(54) VARIABLE LENGTH SKATEBOARD

(71) Applicant: MUFFBRAND LLC, Phoenix, AZ (US)

(72) Inventors: Kevin Robert Crossland, Peoria, AZ (US); Curtis James Crossland, Peoria, AZ (US); Gary Francis Fischer, Phoenix, AZ (US)

( * ) Notice: Subject to any disclaimer, the term of this patent is extended or adjusted under 35 U.S.C. 154(b) by 97 days.

(21) Appl. No.: 14/955,975

(22) Filed: Dec. 1, 2015

Related U.S. Application Data

(60) Provisional application No. 62/086,571, filed on Dec. 2, 2014.

(51) Int. Cl.
*A63C 17/01* (2006.01)
*A63C 17/00* (2006.01)

(52) U.S. Cl.
CPC ..... *A63C 17/0086* (2013.01); *A63C 17/015* (2013.01)

(58) Field of Classification Search
None
See application file for complete search history.

(56) References Cited

U.S. PATENT DOCUMENTS 4,076,265 A * 2/1978 Eash, II ..... A63C 17/0086 280/11.27
4,155,565 A * 5/1979 de Caussin ..... A63C 17/0046 280/11.19
4,234,204 A 11/1980 Tibbals
6,981,711 B2 1/2006 Seta
7,201,387 B2 * 4/2007 Seta ..... A63C 17/0073 280/87.05
7,628,413 B2 12/2009 Gallipoli
7,635,137 B2 12/2009 Gregory
D629,859 S 12/2010 Buksa
7,976,034 B1 * 7/2011 Hong ..... A63C 17/01 280/87.042
2002/0089137 A1 * 7/2002 Chang ..... B62K 3/002 280/87.041
2012/0068427 A1 3/2012 Alva
2014/0062045 A1 3/2014 Rawlins
2014/0131962 A1 * 5/2014 Green ..... A63C 17/004 280/11.26

* cited by examiner

*Primary Examiner* — John Walters
*Assistant Examiner* — Hilary L Johns
(74) *Attorney, Agent, or Firm* — Lisa Foundation Patent Law Clinic at Arizona State University

(57) ABSTRACT

A human transportation device in the form of a variable length skateboard. The variable length skateboard provides a short embodiment allowing the rider greater handling and stopping ability and a long embodiment providing the rider with increased speed ability. The long and short embodiments can quickly and easily be transitioned between at any time or place by the insertion or extraction of at least one removable center deck section. The deck sections are coupled using thumb screw type fasteners and coupler plates thereby removing a need for tools to make the conversion between embodiments. The variable length skateboard provides its owner with multiple embodiments without having to purchase multiple skateboards.

18 Claims, 4 Drawing Sheets

VARIABLE LENGTH SKATEBOARD

CROSS REFERENCE TO RELATED APPLICATION

This application claims benefit of the priority of U.S. Provisional Application Ser. No. 62/086,571, filed Dec. 2, 2014, the contents of which is hereby incorporated by reference in its entirety.

BACKGROUND OF THE INVENTION

Field of the Invention

This invention relates generally to the field of recreational transportation commonly referred to as skateboarding, longboarding, and/or skating.

Description of Related Art

Skateboards are transportation devices comprising typically of a wooden deck with four wheels attached via suspension axles called trucks. The rider typically stands upright on the skateboard and propels the skateboard by pushing one foot on the ground while keeping one foot on the skateboard. The original skateboard design was patented by Tibbals (U.S. Pat. No. 4,234,204) in 1978. Skateboards remained one common length from its inception in 1978 until recently.

The modern trend has been to vary the length of skateboards to achieve different riding characteristics. The Longboard design was patented by Buksa (U.S. Pat. No. D629,859). Longboards are skateboards that are longer than a traditional skateboard. The extended length of a longboard allows for better handling at higher speeds which are commonly encountered on downhill riding. In addition, a shortboard has been created as well. A shortboard allows for increased handling, cornering, and greater ability to stop quickly. These characteristics are useful while riding the short board in urban environments.

Another modern trend has been an attempt to make skateboards more portable. The need for ease of portability has increased as the use of varying lengths of skateboards has increased. Many designs of skateboards exist that are either foldable or are able to be disassembled to create a smaller package which allows for ease of portability.

Gregory (U.S. Pat. No. 7,635,137) has patented a skateboard that has a deck that can be disassembled in to three pieces and truck mounting connector. Gregory's invention focuses on creating a skateboard that is easily portable. However, Gregory's invention consists of skateboard that is always only one length.

Secondly, Hong (U.S. Pat. No. 7,976,034) has patented a foldable skateboard. Hong's invention folds in to three pieces using fixed hinges at the joints. Hong's invention focuses on creating a skateboard that is easily portable. However, Hong's invention consists of a skateboard that is always only one length.

Lastly, Gallipoli (U.S. Pat. No. 7,628,413) has patented a skateboard that has an adjustable length, but is designed as an off-road downhill skateboard.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 4,234,204
U.S. Pat. No. D629,859
U.S. Pat. No. 7,635,137

U.S. Pat. No. 7,976,034
U.S. Pat. No. 7,628,413

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY OF THE INVENTION

Implementations of the present invention may provide among other things a variable length skateboard which is easily converted between a long embodiment and a short embodiment. More specifically, the present invention provides one skateboard that can fulfill the rider's need to have a long skateboard for high speed riding and a short board for urban riding without having to purchase multiple skateboards. In addition, the skateboard can be converted between long and short embodiments quickly and without the use of tools.

The invention may further provide a variable length skateboard having a front deck section comprising a front skateboard truck system and at least two front wheels. The invention also provides a rear deck section comprising a rear skateboard truck system and at least two rear wheels. The invention provides a removable center deck section which is removably coupled to the front and rear deck sections.

Implementations of the present invention may provide at least one coupling plate coupled to the underside of the rear deck section configured to interchangeably couple the rear deck section and the front deck section, and at least one coupling plate coupled to the underside of the center removable deck section configured to couple to the front deck section.

In other embodiments of the present invention, implementations of the present invention may provide a plurality of thumb screw type—or equivalent—fasteners to interchangeably couple the rear coupler plate to the rear deck section and front coupler plate to the removable center deck section.

In other embodiments of the present invention, implementations of the present invention may provide a plurality of fasteners configured to couple the removable center deck section to the rear coupler plate and the front deck section to the front coupler plate.

In other embodiments of the present invention, implementations of the present invention may provide more than one removable center deck section.

Implementations of the present invention may provide skateboard grip tape coupled to the upper side of the front, rear, and removable center deck sections.

Implementations of the present invention may provide a front coupling plate that is countersunk in to the underside of the front deck section and the removable center deck section forming a flush connection between the front deck section and the removable center deck section.

Implementations of the present invention may provide a rear coupling plate that is countersunk in to the underside of the rear deck section and the removable center deck section forming a flush connection between the rear deck section and the removable center deck section.

Implementations of the present invention may provide a plurality of fasteners configured to couple the rear deck section to the rear coupler plate and the removable center deck section to the front coupler plate.

Implementations of the present invention may provide a plurality of thumb screw type—or equivalent—fasteners to interchangeably couple the rear coupler plate to the removable center deck section and front coupler plate to the front deck section.

Implementations of the present invention may provide a rear deck section that comprises 30-40% of the overall length of the skateboard.

Implementations of the present invention may provide a removable center deck section that comprises 35-45% of the overall length of the skateboard.

Implementations of the present invention may provide a front deck section that comprises 15-25% of the overall length of the skateboard.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of pre-AIA 35 U.S.C. §112, ¶6 and post-AIA 35 U.S.C. §112(f). Thus, the use of the words "function," "means" or "step" in the Detailed Description or Description of the Drawings or claims is not intended to somehow indicate a desire to invoke the special provisions of pre-AIA 35 U.S.C. §112, ¶6 or post-AIA 35 U.S.C. §112(f), to define the invention. To the contrary, if the provisions of pre-AIA 35 U.S.C. §112, ¶6 or post-AIA 35 U.S.C. §112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of pre-AIA 35 U.S.C. §112, ¶6 or post-AIA 35 U.S.C. §112(f). Moreover, even if the provisions of pre-AIA 35 U.S.C. §112, ¶6 or post-AIA 35 U.S.C. §112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

Embodiments of the variable length skateboard provide multiple options for the rider. For example, a short embodiment, comprising the front deck section coupled to the rear deck section, provides the rider with exceptional handling and stopping ability for urban environments where those attributes are necessary. The long embodiment, comprising the front and rear deck sections coupled to either end of the removable center deck section, provides the rider with the ability to travel at higher speeds. Other embodiments may incorporate more than one removable center deck sections.

The variable length skateboard can quickly and easily convert between these two different embodiments. The ability to easily switch between the long and short embodiments allows a user to purchase one skateboard to serve multiple needs. The variable length skateboard embodied here also allows a rider to switch between the long and short embodiments at any location simply by traveling with the removable center deck section. A conventional skateboard, longboard, or shortboard do not provide the rider with the ability to choose different lengths while traveling.

Figure 1:
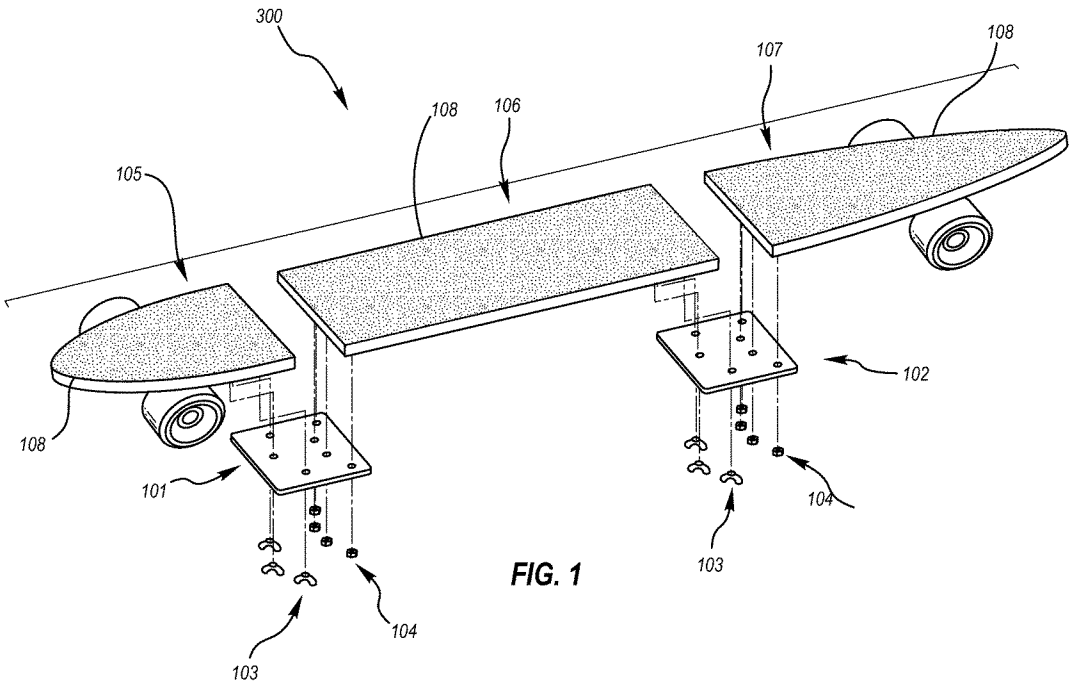
FIG. 1 depicts an exploded view of one implementation of a variable length skateboard.

Referring now to FIG. 1, the long embodiment of a variable length skateboard 300 is shown. In the present embodiment, the variable length skateboard comprises a front deck section 105, a removable center deck section 106, and a rear deck section 107. In various embodiments, a layer of skateboard grip tape 108 is coupled to the upper side of the front deck section 105, the rear deck section 107, and the removable center deck section 106. Further, the front deck section 105 is interchangeably coupled to the removable center deck section 106 with a front coupler plate 101, and the rear deck section 107 is interchangeably coupled to the removable center deck section 106 with a rear coupler plate 102. In various embodiments the front coupler plate 101 and rear coupler plate 102 are coupled to the underside of the respective deck section using a plurality of fasteners 104. The front coupler plate 101 and rear coupler plate 102 are further coupled to the underside of the opposing respective deck section using thumb screw type fasteners, or equivalent, 103 to allow for easy coupling and uncoupling of deck sections. In various embodiments, it may be advantageous to size the deck sections in the manner that provides the greatest overall strength of the variable length skateboard. For example, the front deck section 105 may comprise 15-25% of the total length of the variable length skateboard. The removable center deck section 106 may comprise 35-45% of the total length of the variable length skateboard. The rear deck section 107 may comprise 30-40% of the total length of the skateboard.

Figure 2:
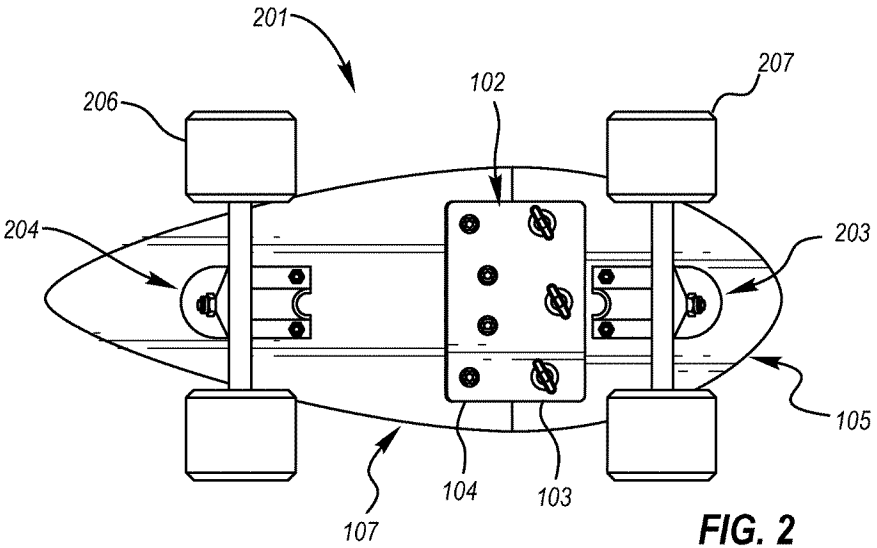
FIG. 2 depicts one implementation of a variable length skateboard in a short embodiment with a removable center deck section removed.

Referring now to FIG. 2, the underside of the short embodiment 201 of the variable length skateboard is shown. In this embodiment, the rear coupler plate 102 is coupled to the underside of the rear deck section 107 with a plurality of fasteners 104. The rear coupler plate 102 is coupled to the underside of the front deck section 105 with a plurality of thumb screw type fasteners or equivalent 103. This embodiment comprises a front skateboard truck 203 having at least two front wheels 207 coupled to the underside of front deck section 105. Further, a rear skateboard truck 204 having at least two rear wheels 206 is coupled to the underside of the rear deck section 107. This embodiment comprises the rear coupler plate 102 being countersunk in to the underside of the rear deck section 107 and the underside of the removable center deck section 106 creating a flush union on the underside of the short embodiment of the variable length skateboard 300. Other embodiments may interchangeably couple the rear coupler plate 102 to the underside of the rear deck section 107 using a plurality of thumb screw type fasteners or equivalent 103 and couple the rear coupler plate 102 to the underside of the front deck section 105 using a plurality of fasteners 104.

Figure 3:
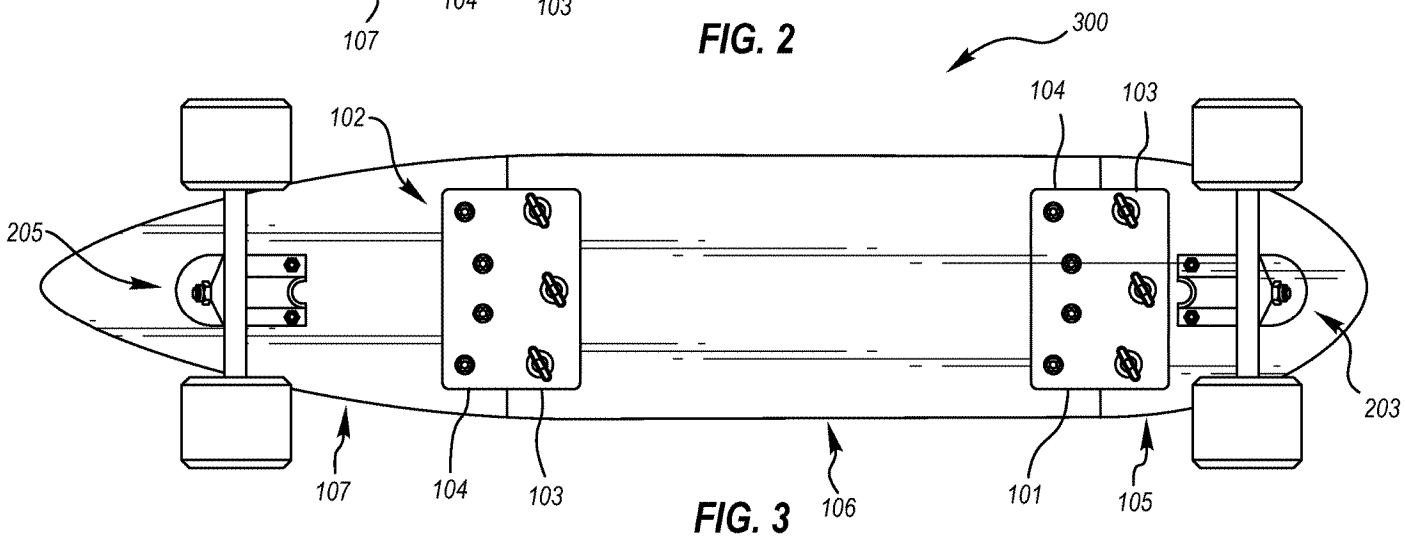
FIG. 3 depicts one implementation of a variable length skateboard in a long embodiment with a removable center deck section present.

Referring now to FIG. 3, the underside of the long embodiment of a variable length skateboard 300 is illustrated. In this embodiment, the rear coupler plate 102 is coupled to the underside of the rear deck section 107 using a plurality of fasteners 104. The front coupler plate 101 is coupled to the underside of the removable center deck section 106 using a plurality of fasteners 104 and is interchangeably coupled to the rear coupler plate 102 using a plurality of thumb screw type fasteners or equivalent 103. The front coupler plate 101 is interchangeably coupled to the underside of the front deck section 105 using a plurality of thumb screw type fasteners or equivalent 103. This embodiment comprises a front skateboard truck 203 having at least two front wheels 207 coupled to the underside of front deck section 105. Further, a rear skateboard truck 204 having at least two rear wheels 206 is coupled to the underside of the rear deck section 107. Further, the front coupler plate 101 is countersunk in to the underside of the front deck section 105 and the underside of the removable center deck section 106 creating a flush union on the underside of the long embodiment of the variable length skateboard 300. The rear coupler plate 102 is countersunk in to the underside of the rear deck section 107 and the underside of the removable center deck section 106 creating a flush union on the underside of the long embodiment of the variable length skateboard 300. Other embodiments may couple the rear coupler plate 102 to the underside of the rear deck section 107 using a plurality of thumb screw type fasteners or equivalent 103 and to the underside of the removable center deck section 106 using a plurality of fasteners 104. The front coupler plate 101 may be coupled to the underside of the front deck section 105 using a plurality of fasteners 104 and to the underside of the removable center deck section 106 using a plurality of thumb screw type fasteners or equivalent 103.

Figure 4:
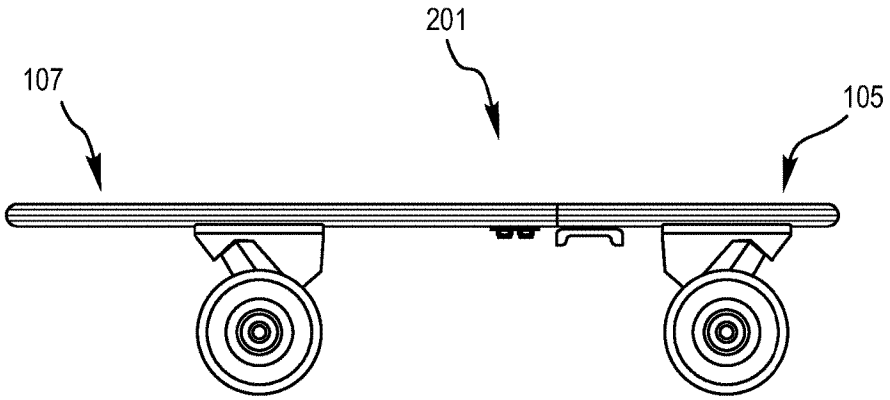
FIG. 4 depicts a profile perspective of a variable length skateboard in a short embodiment with a removable center deck section removed.

Referring now to FIG. 4, a profile view of the short embodiment of a variable length skateboard 201 is illustrated. In this embodiment, the proportions of each deck section are visible. In the short embodiment, the front deck section 105 comprises 30-45% of the total length of the variable length skateboard. Further, the rear deck section 107 comprises 55-70% of the total length of the variable length skateboard. The deck section length percentages of this embodiment exhibit the preferred locations of deck seams to obtain the greatest overall deck strength possible. Further, this embodiment comprises a layered veneer composition of the deck sections. The deck sections may comprise at least two layers of Maplewood or equivalent veneer coupled together with an adhesive element. The veneer and adhesive layers are then compressed using mechanical force. In this embodiment, the veneer layers are shaped using a router, the coupler plates are countersunk using a router, and holes for fasteners are created using a drill.

Figure 5:
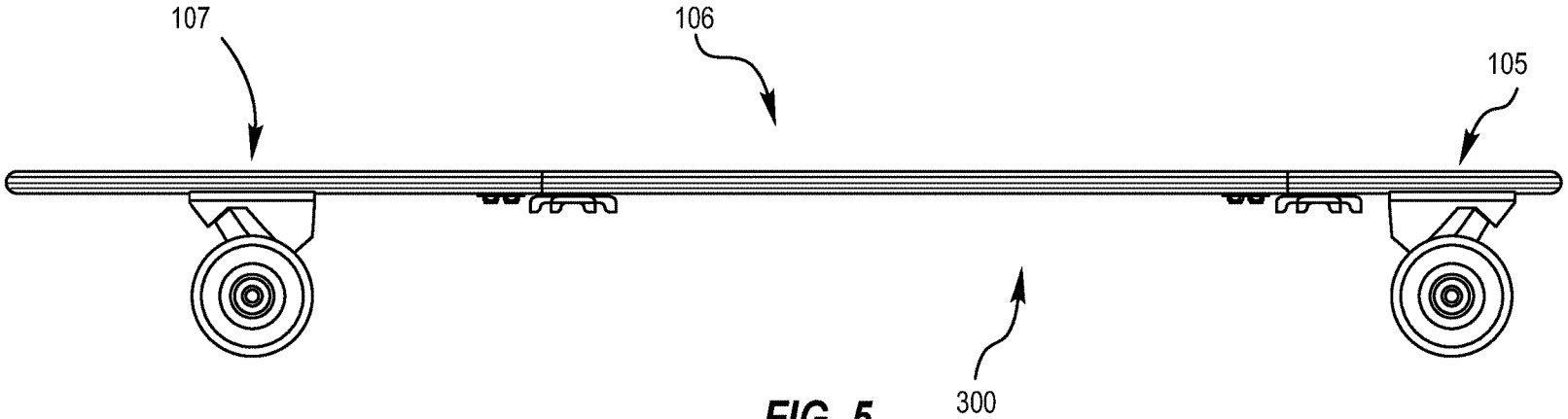
FIG. 5 depicts a profile perspective of a variable length skateboard in a long embodiment with a removable center deck section present.

Referring now to FIG. 5, a profile view of the long embodiment of a variable length skateboard 300 is illustrated. In this embodiment, the proportions of each deck section are visible. In the long embodiment, the front deck section 105 comprises 15-25% of the total length of the variable length skateboard, the rear deck section 107 comprises 30-40% of the total length of the variable length skateboard, and the removable center deck section 106 comprises 35-45% of the total length of the variable length skateboard. The deck section length percentages of this embodiment exhibit the preferred locations of deck seams to obtain the greatest overall deck strength possible. Further, this embodiment comprises a layered veneer composition of the deck sections. The deck sections may comprise at least two layers of Maplewood or equivalent veneer coupled together with an adhesive element. The veneer and adhesive layers are then compressed using mechanical force. In this embodiment, the veneer layers are shaped using a router, the coupler plates are countersunk using a router, and holes for fasteners are created using a drill.

Figure 6:
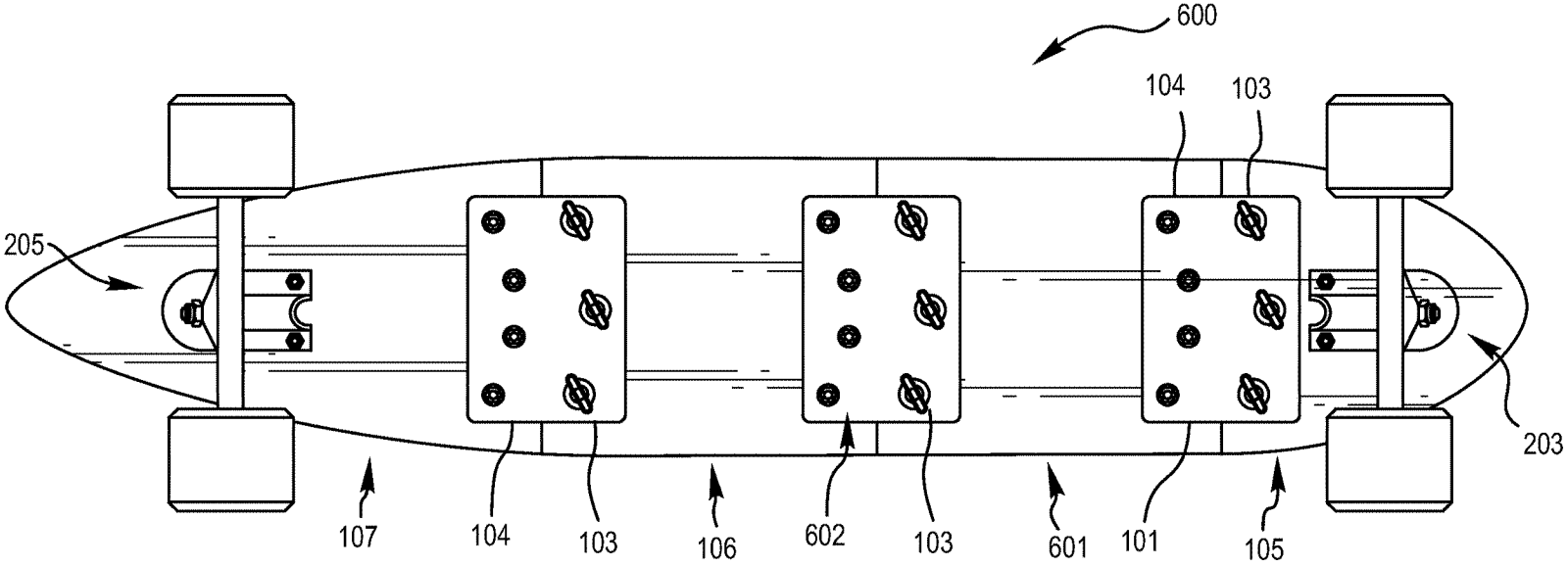
FIG. 6 depicts one implementation of a variable length skateboard in a long embodiment with multiple removable center deck sections present.

Referring now to FIG. 6, the long embodiment of a variable length skateboard with multiple center deck sections 600 is shown. In the present embodiment, the variable length skateboard comprises a front deck section 105, a removable center deck section 106, at least one additional center deck section 601, and a rear deck section 107. In various embodiments, a layer of skateboard grip tape 108 is coupled to the upper side of the front deck section 105, the rear deck section 107, and the removable center deck sections 106, 601. Further, the front deck section 105 is interchangeably coupled to the removable center deck section 106 with a front coupler plate 101, the second center deck section 601 is interchangeably coupled to the center coupler 602, and the rear deck section 107 is interchangeably coupled to the removable center deck section 106 with a rear coupler plate 102. In various embodiments the front coupler plate 101, center coupler plate 602, and rear coupler plate 102 are coupled to the underside of the respective deck section using a plurality of fasteners 104. The front coupler plate 101, center coupler plate 602, and rear coupler plate 102 are further coupled to the underside of the opposing respective deck section using thumb screw type fasteners, or equivalent, 103 to allow for easy coupling and uncoupling of deck sections. In various embodiments, it may be advantageous to size the deck sections in the manner that provides the greatest overall strength of the variable length skateboard. For example, the front deck section 105 may comprise 15-25% of the total length of the variable length skateboard. The removable center deck section 106 may comprise 18-25% of the total length of the variable length skateboard. The second center deck section 601 may comprise 18-25% of the total length of the skateboard. The rear deck section 107 may comprise 30-40% of the total length of the skateboard. The preferred embodiment may include an additional coupler plate for each additional removable deck section. The additional coupler plate may be interchangeably coupled to the additional removable deck section with a plurality of fasteners and thumb screw type fasteners or equivalent.

We claim:

1. A variable length skateboard comprising:

a front deck section comprising a front skateboard truck and at least two front wheels coupled to an underside of the front deck section;

a rear deck section comprising a rear skateboard truck and at least two rear wheels coupled to an underside of the rear deck section;

a removable center deck section removably coupled to the front deck section and the rear deck section;

at least one coupling plate coupled to the underside of the rear deck section configured to interchangeably couple the rear deck section to the removable center deck section and the front deck section; and at least one coupling plate coupled to the underside of the center removable deck section configured couple to the front deck section, wherein when the coupling plate coupled to the underside of the center removable deck section is uncoupled from the rear deck section and the coupling plate of the front deck section is uncoupled, the rear deck section is configured to couple to the front deck section using the coupling plate of the rear deck section.

2. The variable length skateboard of claim 1, wherein the front deck section, center deck section, and rear deck section comprise a layer of skateboard grip tape coupled to the top side of each deck section.

3. The variable length skateboard of claim 1, wherein the front coupling plate is countersunk in to both the underside of the front deck section and the underside of the center deck section forming a flush connection between the front deck section and the center deck section and the rear coupling plate is countersunk in to both the underside of the rear deck section and the underside of the center deck forming a flush connection between the rear deck section and the center deck section.

4. The variable length skateboard of claim 1, wherein the skateboard deck comprises a plurality of fasteners configured to couple the rear deck section to the rear coupler plate and the center deck section to the front coupler plate.

5. The variable length skateboard of claim 1, wherein the skateboard deck comprises a plurality of thumb screw type fasteners configured to interchangeably couple the rear coupler plate to the center deck section and the front coupler plate to the front deck section.

6. The variable length skateboard of claim 1, wherein:

the rear deck section comprises 30-40% of an overall length of the variable length skateboard;

the center deck section comprises 35-45% of the overall length of the variable length skateboard; and the front deck section comprises 15-25% of the overall length of the variable length skateboard.

7. A variable length skateboard comprising:

a front deck section comprising a front skateboard truck and at least two front wheels coupled to an underside of the front deck section;

a rear deck section comprising a rear skateboard truck and at least two rear wheels coupled to an underside of the rear deck section;

a removable center deck section removably coupled to the front deck section and the rear deck section;

at least one coupling plate coupled to the underside of the front deck section configured to interchangeably couple the front deck section to the removable center deck section and the rear deck section; and at least one coupling plate coupled to the underside of the center removable deck section configured couple to the rear deck section, wherein when the coupling plate coupled to the underside of the center removable deck section is uncoupled and the front deck section and the coupling plate of the rear deck section is uncoupled, the front deck section is configured to couple to the rear deck section using the coupling plate of the front deck section.

8. The variable length skateboard of claim 7, wherein the front deck section, center deck section, and rear deck section comprise a layer of skateboard grip tape coupled to the top side of each deck section.

9. The variable length skateboard of claim 7, wherein the front coupling plate is countersunk in to both the underside of the front deck section and the underside of the center deck section forming a flush connection between the front deck section and the center deck section and the rear coupling plate is countersunk in to both the underside of the rear deck section and the underside of the center deck forming a flush connection between the rear deck section and the center deck section.

10. The variable length skateboard of claim 7, wherein the skateboard deck comprises a plurality of fasteners configured to couple the front deck section to the front coupler plate and the center deck section to the rear coupler plate.

11. The variable length skateboard of claim 7, wherein the skateboard deck comprises a plurality of thumb screw type fasteners configured to interchangeably couple the rear coupler plate to the center deck section and the front deck section.

12. The variable length skateboard of claim 7, wherein the rear deck section comprises: 30-40% of an overall length of the variable length skateboard;

the center deck section comprises 35-45% of the overall length of the variable length skateboard; and the front deck section comprises 15-25% of the overall length of the variable length skateboard.

13. A variable length skateboard comprising:

a front skateboard truck and at least two front wheels coupled to an underside of the front deck section;

a rear deck section comprising a rear skateboard truck and at least two rear wheels coupled to an underside of the rear deck section;

at least one removable center deck section removably coupled to the front deck section and the rear deck section;

at least one coupling plate coupled to the underside of the rear deck section configured to interchangeably couple the rear deck section to the removable center deck section and the front deck section; and at least one coupling plate coupled to the underside of the center removable deck section configured couple to the front deck section, wherein when the coupling plates decouple the removable center deck section from the rear deck section and the front deck section, the coupling plate of the rear deck section couples to the front deck section.

14. The variable length skateboard of claim 13, wherein the front deck section, center deck section, and rear deck section comprises a layer of skateboard grip tape coupled to the top side of each deck section.

15. The variable length skateboard of claim 13, wherein the front coupling plate is countersunk in to both the underside of the front deck section and the underside of the center deck section forming a flush connection between the front deck section and the center deck section and the rear coupling plate is countersunk in to both the underside of the rear deck section and the underside of the center deck forming a flush connection between the rear deck section and the center deck section.

16. The variable length skateboard of claim 13, wherein the skateboard deck comprises a plurality of fasteners configured to couple the rear deck section to the rear coupler plate and the center deck section to the front coupler plate.

17. The variable length skateboard of claim 13, wherein the skateboard deck comprises a plurality of thumb screw type fasteners configured to interchangeably couple the rear coupler plate to the center deck section and the front deck section.

18. The variable length skateboard of claim 13, wherein the rear deck section comprises: 30-40% of an overall length of the variable length skateboard;

the center deck section comprises 35-45% of the overall length of the variable length skateboard; and the front deck section comprises 15-25% of the overall length of the variable length skateboard.

* * * * *